United States Patent [19]

Cogswell

[11] 4,291,432

[45] Sep. 29, 1981

[54] ANCHOR CHAIN CLEANING BRUSH

[76] Inventor: Arthur R. Cogswell, 4100 Five Oaks Dr., TH-36, Durham, N.C. 27707

[21] Appl. No.: 140,993

[22] Filed: Apr. 17, 1980

[51] Int. Cl.[3] ..... A46B 3/18

[52] U.S. Cl. ..... 15/160; 15/206; 15/143 R; 15/256.6; 15/246; 114/221 R

[58] Field of Search ..... 15/160, 206, 104.04, 15/143 R, 256.6, 246; 114/221 R

[56] References Cited

U.S. PATENT DOCUMENTS

| | | | |
|---|---|---|---|
| 1,950,959 | 3/1934 | Winsette | 15/256.6 X |
| 2,513,719 | 7/1950 | Glass | 15/206 |
| 2,883,691 | 4/1959 | Gruenwald | 15/143 R X |
| 3,267,507 | 8/1966 | Cox | 15/160 |

FOREIGN PATENT DOCUMENTS

| | | | |
|---|---|---|---|
| 2422893 | 11/1975 | Fed. Rep. of Germany | 15/160 |
| 24259 | of 1897 | United Kingdom | 15/206 |

*Primary Examiner*—Peter Feldman
*Attorney, Agent, or Firm*—B. B. Olive

[57] ABSTRACT

A brush for cleaning mud from anchor chain mounts on a boat hook so that the staff of the boat hook can serve as the handle of the brush during cleaning operations.

4 Claims, 5 Drawing Figures

ANCHOR CHAIN CLEANING BRUSH

BACKGROUND OF THE INVENTION

1. Field of the Invention

The invention relates to apparatus for cleaning anchor chains and specifically to brushes designed for this purpose.

2. Description of the Prior Art

An unpleasant problem for operators of small and medium size boats, both power and sail, is the necessity of cleaning the anchor chain of bottom mud before it is stored aboard. A secure anchorage is frequently one with a sticky mud bottom and if the anchor has lain there for more than a brief time the chain will be filled with mud when brought to the surface. The mud will soil hands, deck, sails, lines, and other gear. If the chain is not well cleaned some of the mud will find its way into the bilge from the chain locker, where it will sour, causing the boat to smell most offensively. Cleaning the bilge of this residue is both unpleasant and difficult.

One practice has been to attempt to clean the chain and anchor by hauling the chain up and down in the water until the mud is removed. This practice is quite difficult and time consuming and particularly so if the mud is sticky and the anchor is heavy. In another practice, particularly for larger boats, the chain is hosed down as it comes aboard. This practice, of course, requires pressurizing and pumping water for this purpose.

So far as is known, there has not been provided a brush especially suited to cleaning anchor chains and adapted to be mounted on a boat hook when in use. Thus, the provision of such a brush becomes the object of the invention.

SUMMARY OF THE INVENTION

The brush device of the invention is in the form of a helical brush which is designed so that its spiral form allows it to twist around an anchor chain and clean it of mud with an up and down motion. An extension of the wire armature of the brush is also helical and is provided with an opening formed by the strands of the wire. This arrangement allows the brush to be firmly attached to a standard boat hook, with the hook of the boat hook fitting into the opening of wire and with the helical extension of the brush armature wrapped tightly around the staff of the boat hook. The brush is thus held firmly in place so that a person holding the staff of the boat hook can conveniently extend the boat hook over the bow of a boat, twist the brush around the anchor line or chain and with up and down strokes, clean the chain of bottom mud before bringing it aboard or likewise clean a rope line.

DETAILED DESCRIPTION OF THE INVENTION

Figure 1:
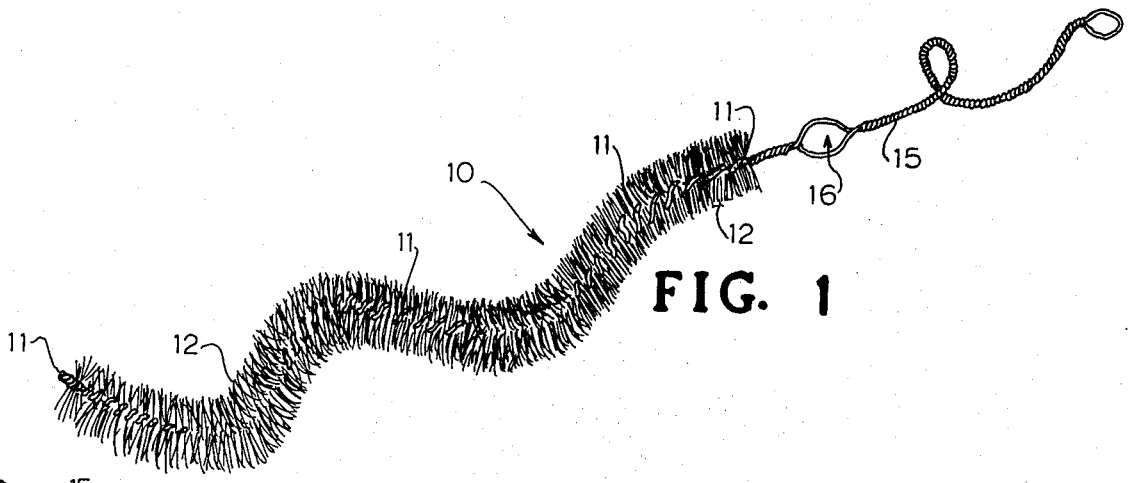
FIG. 1 is a side perspective view of a helical brush according to the invention.
Figure 2:
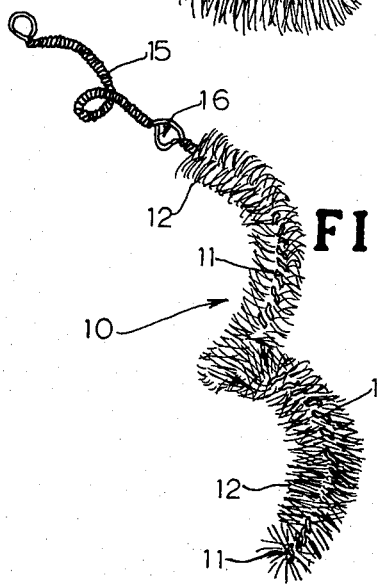
FIG. 2 is an end perspective view.
Figure 4:
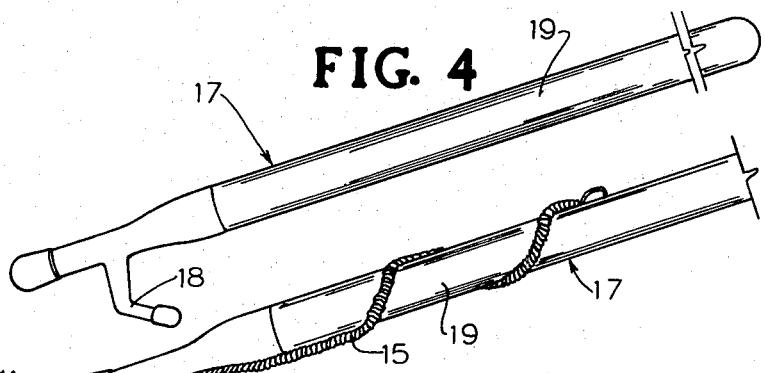
FIG. 4 is a perspective view of a standard-type boat hook
Figure 5:
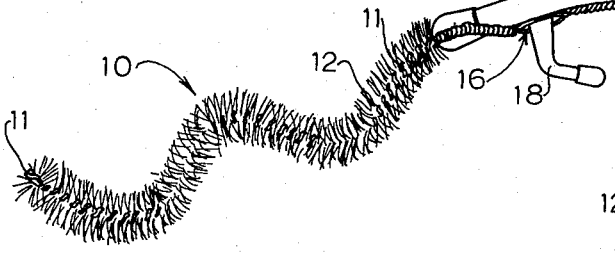
FIG. 5 is a perspective view illustrating how the invention brush is adapted to be mounted on the standard boat hook.
Figure 3:
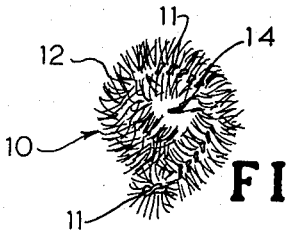
FIG. 3 is an end view.

Making reference to the drawings, the brush 10 of the invention is formed with a body or armature 11 of twisted stiff wire which is preferably galvanized or made of stainless steel. A twisted-in-wire type construction is employed for holding the brush bristles 12 made of nylon, or the like. The armature 11 mounting the brush bristles 12 is twisted into a helix as illustrated and the trailing portion of armature 11 is formed bare for wrapping around the boat hook as later described. The outside brush diameter of the bristles 12 will vary with the size chain being cleaned. However, in practical experience, it has been found that most applications can be met with a brush bristle diameter of about $1\frac{3}{4}''$ before the armature 11 is twisted into a helix and with a finished length of about 14". The bare trailing portion 15, which is designed to wrap around the boat hook, is also preferably of about the same length. Looking endwise of the brush 10 of the invention, it is also desirable that there be formed only a small diameter hole 14 for the chain to pass through the brush thus assuring further cleaning. Of particular significance to the invention, it would be noticed that the bare wire portion 15 includes a round opening 16 formed by the strands of wire making up armature 11 and in use opening 16 is adapted to fit over the hook 18 of the boat hook 17 with the extension portion 15 twisted around the staff 19 of boat hook 17 as best illustrated in FIG. 5. Thus, with brush 10 fitted as described, it may then be twisted around the anchor line or chain and with an up and down motion used to clean the chain at the waterline as it is brought aboard. Since the bristles 12 completely encircle the chain, the bristles tend to reach into and between the links and remove the mud quite thoroughly.

What is claimed is:

1. An integral cleaning brush for cleaning a strand of anchor chain, anchor rope, or the like, comprising:

(a) a relatively stiff, resilient, twisted wire armature having a forward helical brush retaining portion and a trailing helical extension portion;

(b) brush material forming bristles associated with said armature brush retaining portion in a twisted-in-wire configuration; and (c) a loop configuration formed of and as part of said helical extension portion and proximate the trailing end of said brush material, said loop configuration being adapted to pass over the hook of a boat hook when said helical extension portion is wound on the staff thereof such that said staff may serve as a handle for said brush retaining portion enabling said anchor strand to be cleaned by reciprocal motion of said brush material over the length thereof.

2. A brush as claimed in claim 1 wherein said loop configuration comprises a circular opening.

3. A brush as claimed in claims 1 or 2 wherein said strand comprises an anchor chain and said helical brush retaining portion and brush material associated therewith are in a configuration adapted to provide a relatively close fitting opening through said brush during cleaning of said anchor chain.

4. A brush as claimed in claims 1 or 2 wherein the length of said brush material along said brush retaining portion is substantially equal to the length of said extension portion of said armature.

* * * * *